US005225263A

United States Patent [19]

Baravian et al.

[11] Patent Number: 5,225,263

[45] Date of Patent: Jul. 6, 1993

[54] NONWOVENS OF SYNTHETIC CONTINUOUS FILAMENTS INCLUDING AT LEAST A PART WITH MODIFIED SURFACE PROPERTIES, PROCESS FOR THEIR MANUFACTURE AND THEIR APPLICATIONS

[75] Inventors: Jean Baravian, Croissy/Seine; Olivier Chaubet, Lyons; Georges Riboulet, Colmar all of France

[73] Assignee: Frudenberg Spunweb S.A. Societe Anonyme A. Directoire, Colmar, France

[21] Appl. No.: 654,489

[22] Filed: Feb. 13, 1991

[30] Foreign Application Priority Data

Feb. 8, 1990 [FR] France ..... 90 01708

[51] Int. Cl.[5] ..... B32B 27/12; B32B 33/00; D04H 1/46; D04H 11/08

[52] U.S. Cl. ..... 428/95; 156/62.4; 264/210.6; 264/211; 428/288; 428/296; 428/378; 428/391

[58] Field of Search ..... 156/62.4; 264/210.6, 264/211; 428/95, 288, 296, 378, 391

[56] References Cited

U.S. PATENT DOCUMENTS

| | | | |
|---|---|---|---|
| 3,193,516 | 7/1965 | Broatech et al. | 264/170 |
| 3,867,188 | 2/1975 | Campbell et al. | 428/290 |
| 4,480,009 | 10/1984 | Berger | 428/447 |
| 4,659,777 | 4/1987 | Riffle et al. | 525/100 |
| 4,921,670 | 5/1990 | Dallmann et al. | 264/211 |

FOREIGN PATENT DOCUMENTS

| | | |
|---|---|---|
| 1049682 | 2/1979 | Canada . |
| 0242037 | 5/1987 | European Pat. Off. . |
| 0236837 | 9/1987 | European Pat. Off. . |
| 0314586 | 3/1989 | European Pat. Off. . |

*Primary Examiner*—James C. Cannon
*Attorney, Agent, or Firm*—Sherman and Shalloway

[57] ABSTRACT

Nonwovens of synthetic continuous filaments obtained by melt extrusion, in which at least 50% of the filaments contain at least from 0,5 to 3%, preferably from 0.6 to 1.5%, of a polyorganosiloxane introduced into the said filaments during their manufacture.

Process for the manufacture of these nonwovens, in which, before extrusion of the polymer melt to produce the filaments by flowing through orifices of a die, a silicone oil of polyorganosiloxane type is introduced in the proportion at least of 0,5 to 3%, preferably from 0.6 to 1.5% relative to the polymer, into the melt of the latter.

The polyorganosiloxane product employed is of the polydiorganosiloxane type with a molecular weight of between 1,000 and 250,000, preferably between 7,500 and 70,000, corresponding to dynamic viscosities of 50 to 10,000 mPa s; stable under extrusion conditions.

Use of the nonwovens, chiefly as a support for floor coverings with stitched pile.

12 Claims, No Drawings

NONWOVENS OF SYNTHETIC CONTINUOUS FILAMENTS INCLUDING AT LEAST A PART WITH MODIFIED SURFACE PROPERTIES, PROCESS FOR THEIR MANUFACTURE AND THEIR APPLICATIONS

The present invention relates to nonwovens of synthetic continuous filaments, including at least a part with modified surface properties, to the process for their manufacture and to their applications.

The present invention relates more particularly to the nonwovens of continuous filaments employed as backings for floor coverings or carpets with stitched or tufted pile, at least a part of the filaments having a modified surface, thus facilitating the entry of the needles when the pile threads are stitched into the backing.

The use of nonwovens of continuous filaments, generally made of polypropylene or polyester, as backings or supports for pile stitching is well known.

Polyester supports are employed in particular when it is desired to produce particularly stable carpets such as carpet tiles or printed carpets in strips with print patterns capable of being matched from one strip to another, which in this case also require supports of great dimensional stability both during conversion (stitching, dyeing, printing, back-coating, etc.) and for their behaviour after they are laid. They are also employed for the manufacture of moldable tufted carpets for motor vehicles because of their good elongation at break, their tearing strength and because of their good thermal behaviour.

However, the stitching of threads into the supports presents problems. In fact, the entry of the needles gives rise to breakages of strands, of filaments, weakening the mechanical properties of the backing and, consequently, resulting in perturbations during the manufacture and faults in the back of the article, which are detrimental to its robustness and hence to its subsequent use under normal conditions.

The most frequently proposed solution for overcoming this technical problem consists in spraying the nonwoven or the filaments with a lubricating product when they are being manufactured; lubricated in this way, the nonwoven can thus be entered by the needles without damage when the pile is stitched. Such processes are described, for example, in French patent applications published under Nos. 2,174,290 and 2,245,807, in which a product of polysiloxane type is employed.

For spraying the product, these processes require the use of additional plant employed during the manufacture of the nonwoven and continuously with the latter or, subsequently, after the manufacture of the latter, resulting in additional complications and handling costs.

The object of the present invention is to provide a manufacturing process offering a simple, economic answer to the problem which is posed, of maintaining the qualities of the nonwovens when they are entered by needles when the pile is stitched.

The subject of the present invention is nonwovens of synthetic continuous filaments obtained by melt extrusion, which are characterized in that at least 50% of the filaments contain from 0.1 to 3%, preferably from 0.5 to 1.5%, of a polyorganosiloxane introduced into the filaments during their manufacture.

Another subject of the present invention is a process for the manufacture of the above nonwovens, characterised in that, before the extrusion of the polymer melt to produce filaments by passing through the orifices of a die, a silicone oil of the polyorganosiloxane type is introduced, in the proportion of 0.1 to 3%, preferably from 0.5 to 1.5% relative to the polymer, into the melt of the latter, and in the case of only 50% at least of this melt.

A further subject of the present invention is the use of nonwovens thus obtained for the usual applications and more particularly as a backing for floor coverings with stitched pile.

The filaments may be made of any polymer, copolymers or mixtures of synthetic polymers, such as those based on polyester, polyolefin or polyamide. It is quite obvious that the polymers may be employed by themselves or in numbers to produce bilaminar filaments of the core-sheath or side/side type. Polymers of the same chemical nature but of different appearance may also be employed: thus, polyesters such as polyethylene terephthalate and polybutylene terephthalate, polyamides of polyhexamethylene adipamide or polycaprolactam type, polyolefins such as polyethylene or polypropylene; more particularly, in the present invention the use of polyester-based polymers will be dealt with.

The polyorganosiloxane employed is preferably chosen from oils of polydiorganosiloxane type and, preferably, of polydimethylsiloxanes with molecular weights from 1,000 to 250,000 and situated preferably between 7,500 and 70,000, corresponding to dynamic viscosities of 50 to 10,000 mPa s respectively. These oils are nonfunctionalized polydimethylsiloxanes. They are chemically and thermally stable at the polymer melting/spinning temperatures. The proportion in which the silicone oil is introduced in relation to the polymer may vary between 0.1 and 3%, preferably 0.5 to 1.5%.

It has been found that the quantities of product which are introduced into the melt have virtually no perturbing effect on the extrusion, transfer, spinning and filament-drawing conditions; the flow of the melt through the die orifices being made easier thereby because of this kind of lubrication brought about by the product contained in the melt, a part of which later exudes on the surface of the filaments, forming a stable film.

The incorporation of the product into the polymer may be performed before or during the polymer drying stage (a noncontinuous process in which the starting point is polymers in the form of granules, and which must be conditioned before use) using coating or injection, or else during or after the melting of the polymer in the body or the nozzle of the extruder, in general in any region of transfer of the molten polymer before it is converted into filaments.

The product may be introduced into the polymer stream feeding the extruder by means of a volumetric metering pump. Mass-based metering is, of course completely applicable to the operation.

The process which is employed for the production of the continuous-filament nonwovens is of known type; it is possible, for example, to employ that described in the French patents published under No. 1,601,049 or No. 2 ,299,438 by the Applicant Company, the bonding of the sheet being performed by needling or heat-bonding with or without resin.

The product may be introduced into all of the polymer(s) employed or only into a proportion of the latter, the retention of the target properties concerning the stability of the nonwoven and its ease of being entered by the needles being produced with at least 50% of the filaments containing the product. It is thus possible to extrude two different polymers in the form of separate or bilaminar filaments as mentioned before, with a proportion of the filaments in the first case or a single lamina in the second case containing the product.

To implement the present invention, use will preferably be made of the nonwovens described in the Applicant's French Patent published under No. 2,546,537, in which two polyester-based polymers are employed: polyethylene terephthalate and polybutylene terephthalate.

The nonwovens of the present invention are employed for all the usual textile or technical applications of nonwovens either by themselves or chiefly as a support for nonwovens with stitched pile. They can be coupled with other nonwovens and, if appropriate, reinforced with threads which are mutually parallel, preferably in the length direction; they may be subjected to any embossing, forming, molding impregnating, coating or similar handling operation.

Various tests described below are employed for differentiating the nonwovens of the invention from nonwovens not containing product in the bulk of the filaments.

MEASUREMENT OF THE NEEDLE ENTRY FORCE a) In Laboratory

The measurement of force of entry of a row of tufting needles into the sheet which is consolidated by heat-bonding is performed as follows:

3 small bars of Singer tufting needles series No. 82,753, each comprising 12 needles are welded side by side on the same line, forming a 9-cm wide row of needles. This assembly is attached to the movable jaw of a tensometer and enters (at the speed of 1,000 m/min) the fixed nonwoven surface stretched on a suitable device at right angles to the movement of the needles.

b) On Tufting Machine

The test is performed on a Singer-Cobble machine with 1/10"-gauge needles, the pile thread employed being a curled multifilament continuous yarn of 1,100 dtex/88 strands Z torsion 150×2S 150 45, 40-point tension.

DETERMINATION OF THE PRODUCT INTRODUCED INTO THE BULK ON FILAMENTS PRESENT IN THE NONWOVEN a) Determination of the Total % of Silicone (core +surface of the filaments)

By ethoxylation and gas phase chromatography: digestion of the nonwoven in an alkaline medium. This method makes it possible to individualize each silicone atom, leaving it with its initial chemical environment. Analysis is then carried out using gas phase chromatography.

b) Determination of % of Silicone at the Surface of the Filaments

By extraction with cyclohexane at 30° C., followed by weighing the residue after evaporation of the solvent. The determination of the silicone in this extract is then carried out, corresponding to the various products present at the surface of the filament, chiefly silicone and oligomers.

The following examples illustrate the present invention without limiting it:

EXAMPLE 1

As described in the Applicant's French patent published under No. 2,546,537, a nonwoven sheet is produced, of 120 g/m$^2$ of continuous filaments containing 2 types of polyethylene glycol (2GT) (85%) and polybutylene glycol (4GT) (15%) filaments of 6 and 4 dtex counts respectively, by employing for depositing the filaments the travelling process which is the subject of the Applicant's French patent published under No. 2,299,438.

1% of Rhodorsil 47 V 350 silicone oil (polydimethylsiloxane with a viscosity of 350 mPa s relative to the weight of the 2GT granules) from Rhône-Poulenc is introduced using a metering pump, upstream of the 2GT extruder.

The sheet is needled on a single-stroke needler at a rate of 50 perforations/cm$^2$ with Singer needles of 40-Rb gauge, 15-mm entry.

The sheet is then heat-bonded by running "S"-fashion over a calender with two heating rolls at 230° C., the pressure force between the rolls is 12 daN/cm and the total time of contact between the sheet and the hot rolls is 9 seconds; it is then cooled and wound.

The determination of the silicone oil which has exuded at the surface of the filaments gives a silicone content of 0.05% relative to the weight of the sheet, the quantity of silicone relative to the weight of the sheet being 1%. The force of entry of the needles is, according to the laboratory test, 23.6 daN in the case of the sheet without silicone and 15.7% daN in the case of the sheet obtained as above, showing unambiguously the difference in the entry forces and the advantage of employing the silicone product.

On a tufting machine, the sheet without silicone is impossible to run: breakage of filaments, and complete deterioration of the support after tearing occur, whereas the silicone-treated sheet results in an excellent tufting.

Tests were carried out according to previous methods using full-bath fulling in an aqueous silicone dispersion so as to have a dry deposit of 0.5% of silicone relative to the weight of the nonwoven: the results are of the same order as those obtained with the sheet containing a silicone product in the bulk. The economy of the process, however, argues in favor of the present invention.

The tufted carpet has mechanical properties and a sufficient stability for being converted, after coating with bitumen on the reverse side, as tiles for floor covering.

EXAMPLE 2

A nonwoven sheet of 120 g/cm$^2$ of polyethylene terephthalate continuous filaments with a count of 7 dtex is produced using the process outlined in Example 1, care having been taken to introduce into the polymer 0.5% of silicone oil (polydimethylsiloxane with a viscosity of 1,000 mPa s) relative to the weight of polymer.

The sheet is then needled with Singer 40 RB needles at a rate of 80 perforations/cm$^2$ and 13 mm of entry on 1 single face.

A heat treatment is then carried out by hot calendering between 2 rolls heated to a temperature of 235° C. with a pressure force of 25 daN/cm and a contact time of 8 seconds.

This support is tufted without any difficulty and exhibits all the toughness and deformability properties required for the production of a moldable floor carpet for a motor vehicle.

EXAMPLE 3

A nonwoven sheet of 115 g/m$^2$ of continuous filaments containing 2 types of filaments 2GT 88% and 4GT 12% with counts of 9 and 5 dtex respectively is produced using the process outlined in Example 1.

1.5% of Rhodorsil 47V2000 silicone oil (polydimethylsiloxane with a viscosity of 2,000 mPa s) relative to the weight of 2GT granules is introduced using a metering pump, before the 2GT extruder.

The sheet is needled on a single-stroke needler at a rate of 60 perforations per cm$^2$ with Singer 40-Rb gauge needles with a depth of entry of 14 mm. The sheet is then heat-bonded by running over a perforated drum with air passing through at a temperature of 242° C. with a contact time of 15 seconds, and is then sized with the aid of a calender with metal rolls heated to 230° C., with a gap between the rolls which are preset so as to set the density of the heat-bonded sheet to 0.19, that is to say a thickness of 0.6 mm. This sheet exhibits all the tuftability properties, mechanical properties and dimensional stability for making a support for a floor covering with stitched pile as a strip and capable of being printed with patterns which can be matched from one strip to the next.

EXAMPLE 4

A nonwoven sheet composed of 125 g/m$^2$ continuous filaments and consisting of coaxial filaments whose core is made of polyethylene terephthalate and sheath of polybutylene terephthalate is produced using the process outlined in Example 1.

The core represents 80% of the mass of the coaxial filament and the sheath 20%.

Care will have been taken to introduce 0.8% of a 47V1200 silicone oil (polydimethylsiloxane with a viscosity of 1200 mPa s) relative to the weight of polyester into the 4GT polymer constituting the sheath, this being done at the nozzle of the extruder by means of a volumetric metering device.

The count of the coextruded filaments is 10 dtex.

The nonwoven sheet will then be consolidated under the conditions of Example 3.

The heat-bonded support thus obtained will have all the appearance, mechanical performance, tuftability and stability properties needed for the production of a velvet carpet presented in tile form.

We claim:

1. A nonwoven fabric suitable for use as a backing to which a pile yarn can be stitched to form a pile floor covering comprising synthetic continuous filaments obtained by melt extrusion of polyester, in which at least 50% of the filaments comprise at least from 0.5 to 3% of a polyorganosiloxane oil introduced into the polymer melt during the extrusion.

2. The nonwoven fabric according to claim 1, wherein the nonwoven comprises at least 50% of polyethylene terephthalate filaments containing from about 0.6 to 3% of said polyorganosiloxane oil and less than 50% of polybutylene terephthalate filaments.

3. The nonwoven fabric according to claim 1 wherein the filaments comprise at least from about 0.6 to about 1.5% of said polyorganosiloxane oil.

4. The nonwoven fabric according to claim 1 wherein said nonwoven fabric comprises at least two compatible polyester polymers wherein one polymer comprises at least 0.3 to 3% of said polyorganosiloxane oil.

5. The nonwoven fabric according to claim 1, wherein the polyorganosiloxane is a polydiorganosiloxane having a molecular weight of between about 1,000 to 250,000, corresponding to dynamic viscosities in the range of about 50 to 10,000 mPa s, wherein the polyorganosiloxane is stable under the extrusion conditions.

6. The nonwoven fabric according to claim 5 wherein the polydiorganosiloxane has a molecular weight in the range of from about 7,500 to about 70,000.

7. A stitched pile floor covering comprising the nonwoven fabric of claim 1 as a backing and pile yarn stitched to said backing.

8. The stitched pile floor covering of claim 7 wherein the nonwoven fabric backing is heatbonded prior to stitching said pile yarn thereto.

9. A process for the manufacture of the nonwoven fabric according to claim 1, comprising, before extrusion of the polymer melt to produce filaments by passing through orifices of a die, introducing a polyorganosiloxane oil in the proportion of at least about 0.5 to 3% relative to the polymer, into the melt of the polymer by injection into the nozzle of the extruder after melting the polymer.

10. The process for the manufacture of the nonwoven fabric according to claim 9 wherein the introduction of the polyorganosiloxane oil is performed by injection into the body of the extruder during the melting of the polymer.

11. The process for the manufacture of the nonwoven fabric according to any one of claims 9 to 10, a number of polymers are extruded and wherein the polyorganosiloxane oil is introduced into at least one of the polymers.

12. The process according to claim 9 wherein the polyorganosiloxane oil is present in an amount of from about 0.6 to about 1.5% relative to the polymer.

* * * * *